US005300987A

United States Patent [19]

Aoyama et al.

[11] Patent Number: 5,300,987

[45] Date of Patent: Apr. 5, 1994

[54] IMAGE FORMING APPARATUS WHICH REDUCES OR ELIMINATES DENSITY IRREGULARITY DUE TO THERMAL DEFORMATION OF A DEVELOPING SLEEVE

[75] Inventors: Takeshi Aoyama, Yokohama; Toru Katsumi, Kawasaki, both of Japan

[73] Assignee: Canon Kabushiki Kaisha, Tokyo, Japan

[21] Appl. No.: 73,065

[22] Filed: Jun. 8, 1993

[30] Foreign Application Priority Data

Jun. 11, 1992 [JP] Japan ..... 4-179295
Sep. 24, 1992 [JP] Japan ..... 4-254755

[51] Int. Cl.[5] ..... G03G 15/06

[52] U.S. Cl. ..... 355/245; 118/656; 118/657; 355/208; 355/211; 355/251

[58] Field of Search ..... 355/208, 210, 211, 245, 355/251, 259; 118/653, 656–658

[56] References Cited

U.S. PATENT DOCUMENTS 5,019,862 5/1991 Nakamura et al. ..... 355/208
5,066,988 11/1991 Miyake ..... 355/245

FOREIGN PATENT DOCUMENTS 0296270 11/1989 Japan ..... 355/211
0306282 12/1990 Japan ..... 355/211

*Primary Examiner*—A. T. Grimley
*Assistant Examiner*—William J. Royer
*Attorney, Agent, or Firm*—Fitzpatrick, Cella, Harper & Scinto

[57] ABSTRACT

An image bearing member of an image forming apparatus is heated both during an image forming operation and during an inoperative condition. At least two developing sleeves are opposed to the image bearing member. An angular difference between an angle by which one of the developing sleeves is rotated until any point on the image bearing member reaches a first position where a distance between the one developing sleeve and the image bearing member is minimum, and an angle by which the other developing sleeve is rotated until the point on the image bearing member reaches a second position where a distance between the other developing sleeve and the image bearing member is minimum, becomes $(2\pi/S)\times k$ (rad.), where S is the number of the developing sleeves and k is an integral number excluding multiples of S.

4 Claims, 10 Drawing Sheets

IMAGE FORMING APPARATUS WHICH REDUCES OR ELIMINATES DENSITY IRREGULARITY DUE TO THERMAL DEFORMATION OF A DEVELOPING SLEEVE

BACKGROUND OF THE INVENTION

1. Field of the Invention

The present invention relates to an image forming apparatus for developing an electrostatic latent image to form a visualized image.

2. Related Background Art

It is practical that an image bearing member such as an electrophotographic is heated to a predetermined temperature (for example, about 40° C.) by a heater disposed within the image bearing member in order to prevent the occurrence of image flow due to the adhesion (dewing) of moisture in the air to the image bearing member bearing an electrostatic latent image, to improve the photosensitivity of the image bearing member and to stabilize the surface potential of the image bearing member.

The heater heats the image bearing member to keep the image bearing member at a predetermined temperature not only during the image forming operation, but also during an inoperative condition of the image forming apparatus so that an image forming operation can be started at any time.

A developing device for developing the electrostatic latent image has a developing sleeve arranged in a confronting relation to the image bearing member. During the image forming operation, the developing sleeve is rotated to apply developer to the image bearing member; whereas, in the inoperative condition, the developing sleeve is stopped, in a position opposite the image bearing member.

As mentioned above, since the image bearing member is being heated by the heater even in the inoperative condition, only a surface of the stopped developing sleeve which is opposed to the image bearing member is subjected to radiant heat from the image bearing member. Consequently, since a portion of the surface of the developing sleeve which is opposed to the image bearing member is thermally expanded, and the remaining surface of the developing sleeve is not thermally expanded, as shown in FIG. 1B, the developing sleeve 15 is deformed to have slight deflection. (Note, the deflection of the developing sleeve is exaggerated in FIG. 1B to facilitate understanding of this feature). After the developing sleeve is rotated, since the whole peripheral surface of the developing sleeve is uniformly subjected to the radiant heat from the heater 21 in the image bearing member 3, the developing sleeve gradually returns to its original straight condition as shown in FIG. 1A.

If the developing sleeve starts to rotate from the deflected condition as shown in FIG. 1B, then a minimum distance X between the image bearing member 3 and the developing sleeve 15 will vary periodically. One period (cycle) corresponds to one revolution of the developing sleeve 15. If the distance X is periodically varied, an amount of the developer applied from the developing sleeve 15 to the image bearing member 3 will also be periodically changed, because the intensity of an electric field generated between the image bearing member and the developing sleeve by applying the developing bias voltage to the developing sleeve will be periodically varied in response to the variation of the distance X. In any case, the shorter the distance X, the greater the developer amount applied to the image bearing member 3, and the longer the distance X, the smaller the developer amount applied to the image bearing member. Therefore, a periodic density irregularity will occur in the developed image. Such density irregularity will be noticeable particularly in a developing device wherein the developer is transferred from a developing sleeve 15 to an image bearing member 3 by scattering the developer without contacting a layer of the developer carried on the developing sleeve 15 with the image bearing member 3.

SUMMARY OF THE INVENTION

An object of the present invention is to reduce or eliminate the density irregularity of an image due to the thermal deformation of a developing sleeve in an image forming apparatus wherein an image bearing member is heated even in an inoperative condition.

Another object of the present invention is to provide an image forming apparatus which can improve the density of an image while reducing the density irregularity of the image.

Other objects and features of the present invention will be apparent from the following descriptions.

DETAILED DESCRIPTION OF THE PREFERRED EMBODIMENTS

Figure 2:
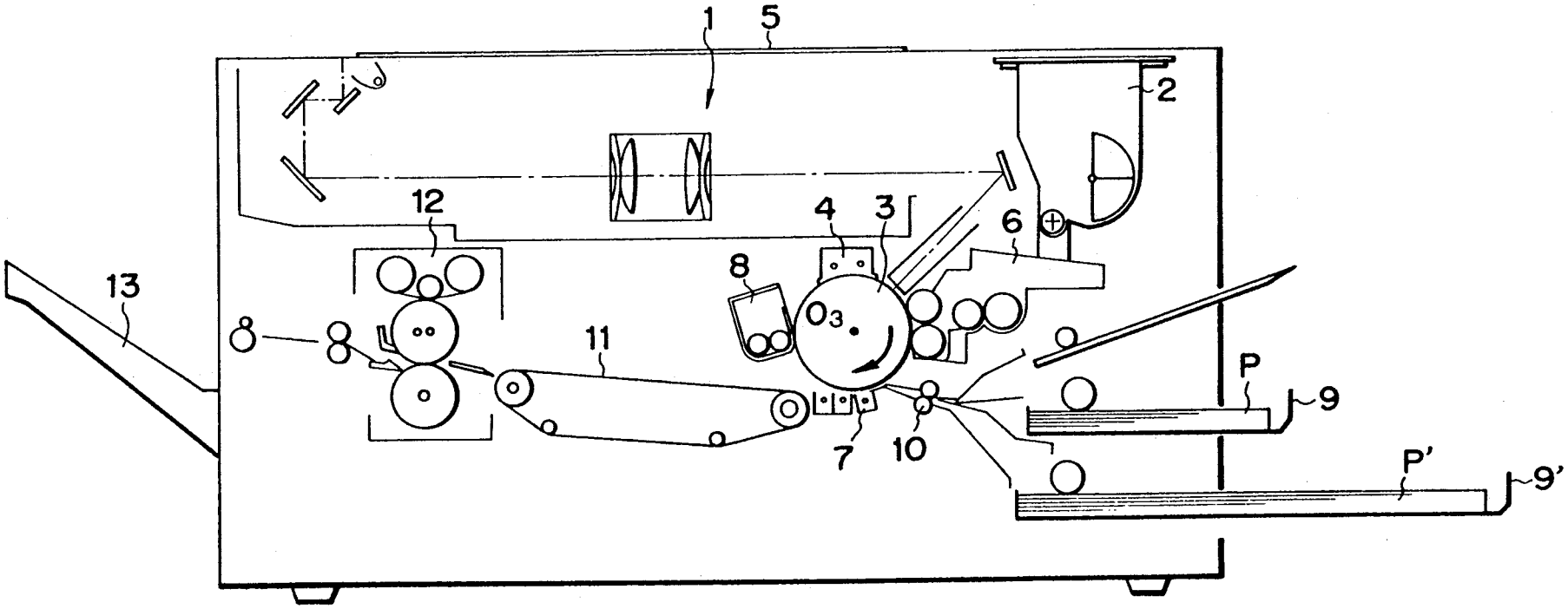
FIG. 2 is a schematic elevational sectional view of an electrophotographic apparatus to which the present invention is applied.

An electrophotographic apparatus shown in FIG. 2 comprises a cylindrical photosensitive drum 3 having an amorphous silicone layer as a photoconductive layer. Regarding the amorphous silicone layer, since image flow is particularly apt to occur due to the adhesion of moisture in the air, as shown in FIG. 3, a heater 21 is arranged in the photosensitive drum 3 which heats the photosensitive drum not only during the image forming operation but also during an inoperative condition.

Figure 3:
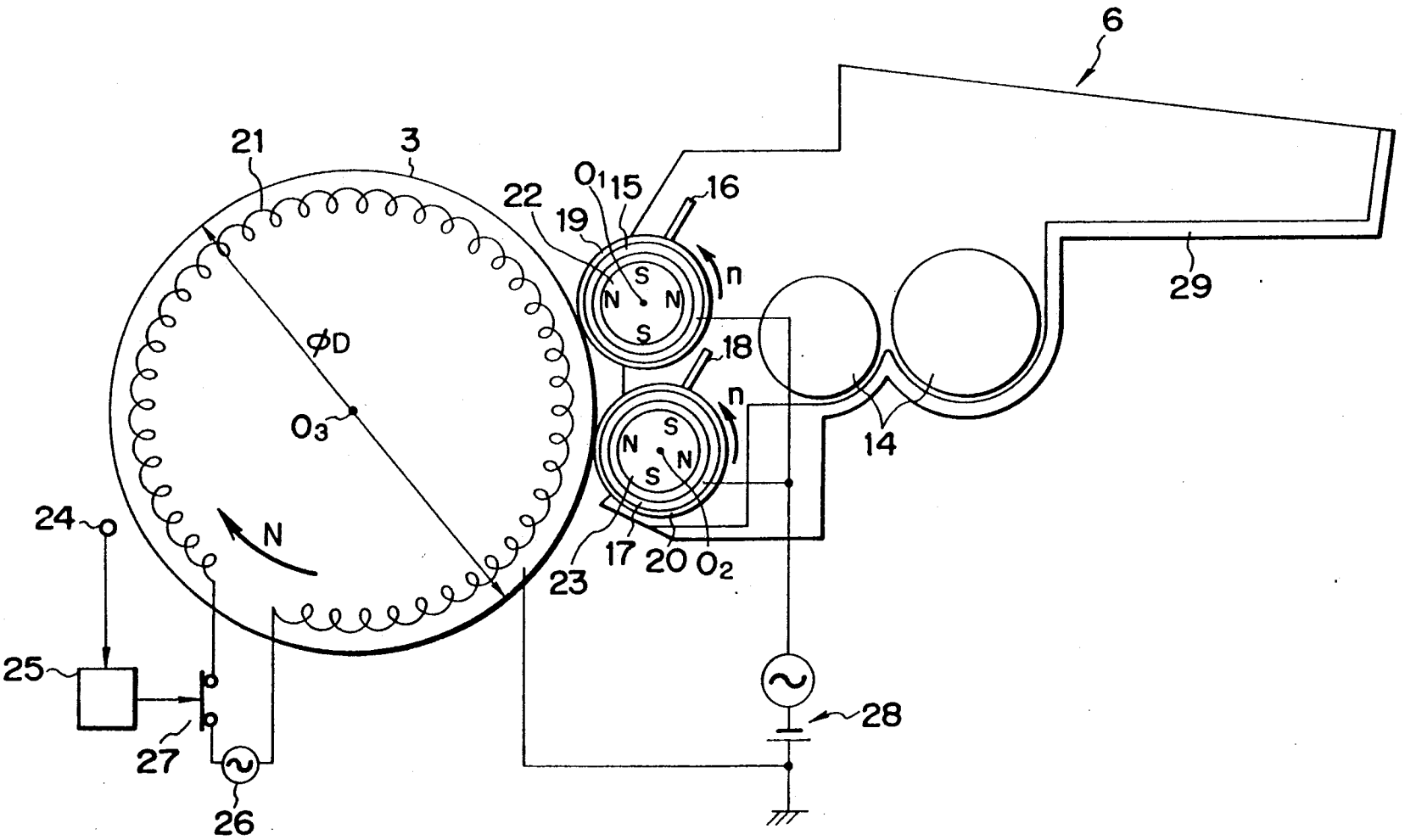
FIG. 3 is an enlarged sectional view of a main portion of the apparatus of FIG. 2.

In FIG. 3, a sensor 24 serves to detect a surface temperature of the photosensitive drum 3, and a temperature control circuit 25 controls the temperature of the drum 3 to maintain it at a predetermined value (for example, about 40° C.) by turning ON and OFF a switch 27 between the heater 21 and a heater power source 26 in response to a signal from the sensor 24.

In an image forming operation wherein an electrostatic latent image is formed and the latent image is developed to form a toner image on the drum 3, which toner image is in turn transferred onto a transfer sheet and then the transferred toner image is fixed to the transfer sheet, the photosensitive drum 3 is rotated in a direction shown by the arrow in FIG. 2 (clockwise direction) around a central shaft $O_3$ of the drum. The photosensitive drum 3 rotating in the clockwise direction is firstly charged uniformly by a charger 4, and then a light image from an original rested on an original support 5 is illuminated onto the photosensitive drum by an optical system 1, thereby forming an electrostatic latent image on the drum 3. The latent image is developed by a developing device 6. A toner image formed on the drum 3 is transferred onto a sheet (transfer sheet) P or P' supplied from a sheet supply cassette 9 or 9' by a pair of registration rollers 10, using a transfer charger 7. After the transfer sheet is separated from the drum 3, it is sent, by a belt 11, to a fixing device 12, where the toner image is permanently fixed to the sheet. After the fixing operation, the sheet is discharged onto a tray 13. After the transferring operation, the residual toner remaining on the surface of the drum 3 is removed by a cleaner 8.

Incidentally, when the image forming operation is stopped, rotation of the drum 3 is also stopped. Further, developer (toner) is replenished into the developing device 6 from a hopper 2.

As shown in FIG. 3, the developing device 6 comprises a container 29 for containing magnetic toner as an one-component developer.

Two cylindrical developing sleeves 15, 17 are rotatably supported by the container 29. The sleeves 15 and 17 are arranged along the rotational direction of the drum 3 in order and are opposed to the drum 3 with a small gap in range of 50–500 μm therebetween, respectively. Spacer rollers 19, 20 are arranged coaxially with sleeves 15, 17, respectively, so that these spacer rollers are abutted against the drum 3 to create the above-mentioned small gaps.

Magnets 22, 23 are fixed within the sleeves 15, 17, respectively, so that the magnetic toner can be magnetically adhered to the sleeves 15, 17.

Figure 1A:
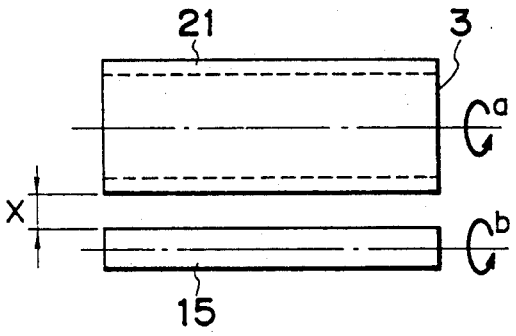
FIGS. 1A to 1C are explanatory views for explaining a conventional drawback.
Figure 1B:
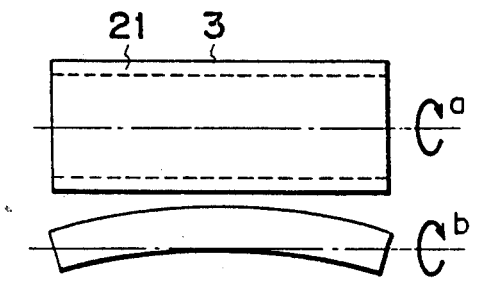
Figure 1C:
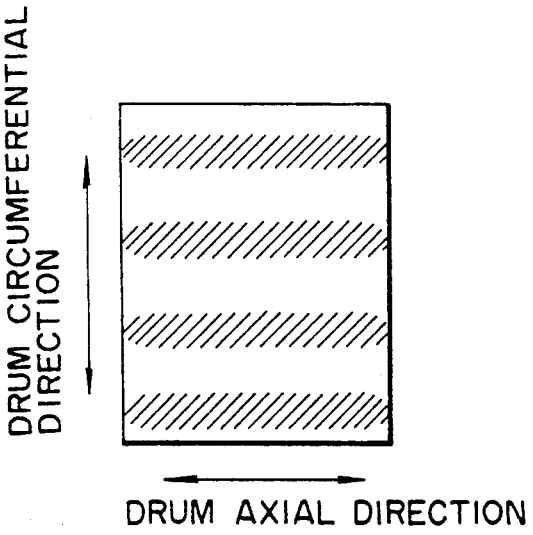

Since the rotation of sleeves 15, 17 is stopped during the inoperative condition (non-image forming operation), the sleeves are subjected to thermal deformation during the inoperative condition, as shown in FIG. 1B.

During the image forming operation, the sleeves 15, 17 are rotated in directions shown by the arrows (anticlockwise directions) around central shafts $O_1$, $O_2$, respectively. Due to such rotations, the sleeves 15, 17 convey and supply the magnetic toner to the photosensitive drum 3. Of course, sleeves 15, 17 supply toners having the same color (for example, black) to the photosensitive drum 3.

The thickness of a layer of the toner carried by the sleeves 15, 17 and supplied to the photosensitive drum 3 is smaller than the gap between the sleeves 15, 17 and the photosensitive drum 3 at the developing station of the respective developing sleeves 15, 17. That is to say, the sleeves 15, 17 develop the latent image using a non-contacting developing method.

In order to improve the developing efficiency, an oscillating bias voltage obtained by overlapping an AC voltage with a DC voltage is applied to each of sleeves 15, 17 from a power source 28. As a result, oscillating electric fields are generated in the developing station between the sleeve 15 and the drum 3 and in the developing station between the sleeve 17 and the drum 3. In this way, toner particles will fly from the sleeves 15, 17 and adhere to the electrostatic latent image.

Incidentally, DC bias voltages may be applied to the sleeves 15, 17.

In any case, each developing station wherein the toner is transferred from the respective sleeve 15 or 17 to the photosensitive drum 3 is defined by the position where the distance between the sleeve and the drum is minimum and therearound.

As mentioned above, since developers having the same color are successively applied to the same electrostatic latent image from two developing sleeves 15, 17, even when the photosensitive drum 3 is rotated at a high speed, it is possible to obtain a toner image having a sufficient high density.

Incidentally, in FIG. 3, the reference numeral 14 denotes agitating members for loosening the developer in the container 29 and for supplying the developer to the sleeves 15, 17.

Now, an embodiment of the present invention will be further fully explained with reference to FIG. 4.

Figure 4:
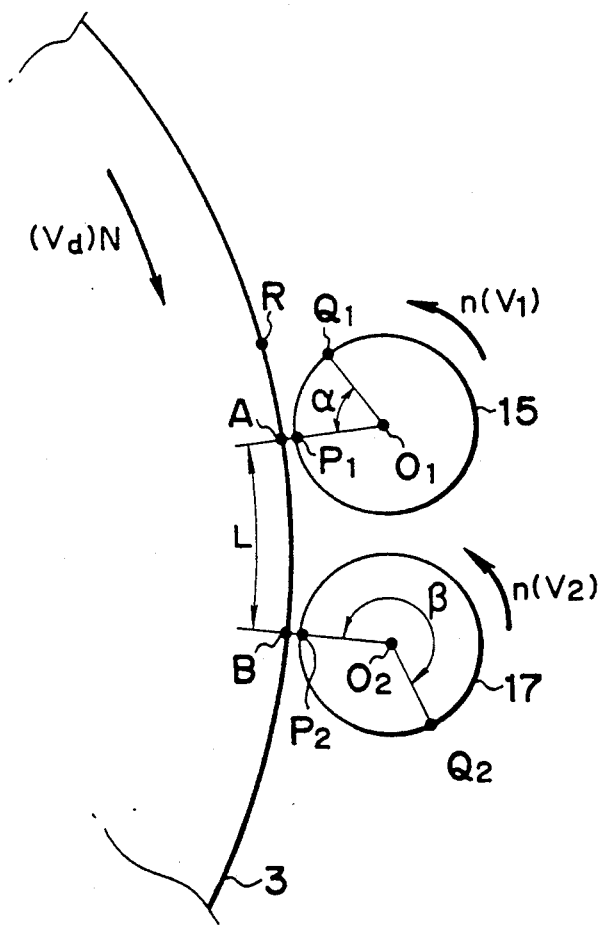
FIG. 4 is an enlarged view for explaining an embodiment of the present invention.

In FIG. 4, a point A is a position on the photosensitive drum 3 where the distance between the photosensitive drum 3 and the developing sleeve 15 is minimum, and a point B is a position on the photosensitive drum 3 where the distance between the photosensitive drum 3 and the developing sleeve 17 is minimum. A point $P_1$ is a position on the developing sleeve 15 where the distance between the photosensitive drum 3 and the developing sleeve 15 is minimum, and a point $P_2$ is a position on the developing sleeve 17 where the distance between the photosensitive drum 3 and the developing sleeve 17 is minimum.

The photosensitive drum 3 is rotated in a direction shown by the arrow (clockwise direction) at an angular velocity of N (rad./sec.). The developing sleeves 15, 17 are rotated in clockwise directions shown by the arrows, respectively. An angular velocity n (rad./sec.) of the developing sleeve 15 is the same as that of the developing sleeve 17.

Now, it is assumed that any point on the photosensitive drum 3 (for example, a tip end position of the electrostatic latent image in the rotational direction of the photosensitive drum) is R. Further, it is assumed that, as the photosensitive drum 3 is rotated, the sleeve 15 is rotated by an angle of $\alpha$ (rad.) until the point R is moved to the point A (from the position shown in FIG. 4). That is, when the point R on the photosensitive drum 3 reaches the point A, a point $Q_1$ on the developing sleeve 15 reaches the point $P_1$ so that a distance between the points R and $Q_1$ becomes minimum.

Further, it is assumed that the sleeve 17 is rotated by an angle of $\beta$ (rad.) until the point R is moved to the point B (from the position shown in FIG. 4). That is, when the point R on the photosensitive drum 3 reaches the point B, a point $Q_2$ on the developing sleeve 17 reaches the point $P_2$ so that a distance between the points R and $Q_2$ becomes minimum.

With this arrangement, when a difference $(\beta-\alpha)$ between the angles $\beta$ and $\alpha$ is $(2\pi/2)\times k$ (rad.) (where, k is an integral number excluding multiples of 2 (i.e., 2, 4, 6 . . . )), it is possible to reduce the above-mentioned density irregularity of the image due to the thermal deformation of the sleeves 15, 17.

The reason is that a portion of the photosensitive drum which is opposed to the convexly deformed portion of the sleeve 15 is then opposed to the concavely deformed portion of the sleeve 17, and a portion of the photosensitive drum which is opposed to the concavely deformed portion of the sleeve 15 is then opposed to the convexly deformed portion of the sleeve 17. That is, a portion of the latent image which has been densely developed by the sleeve 15 is then thinly developed by the sleeve 17, and a portion of the latent image which has been thinly developed by the sleeve 15 is then densely developed by the sleeve 17.

Figure 5A:
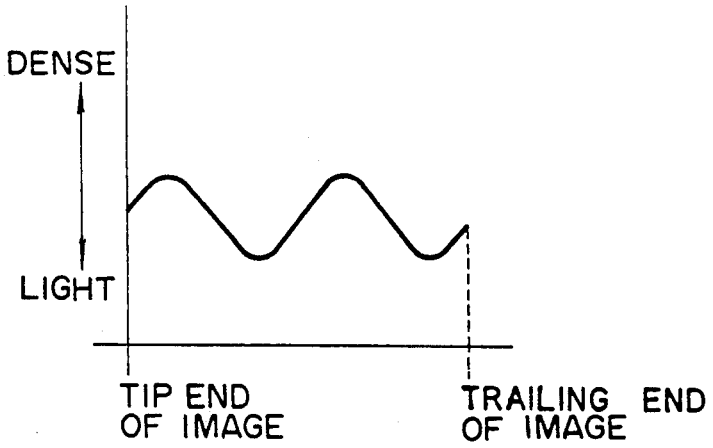
FIGS. 5A to 5C are graphs for explaining characteristics o the embodiment of FIG. 4.
Figure 5B:
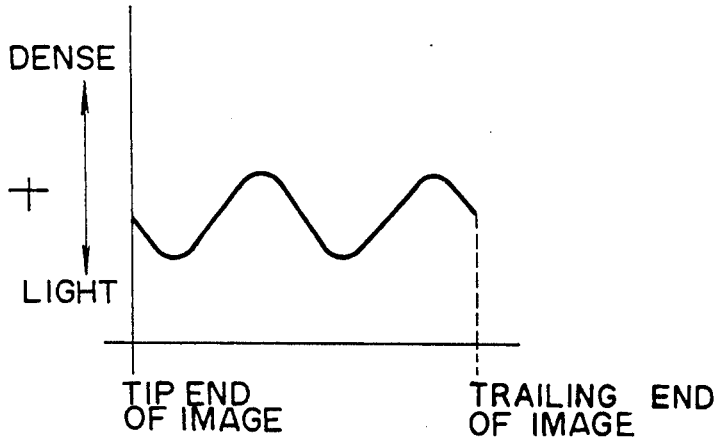
Figure 5C:
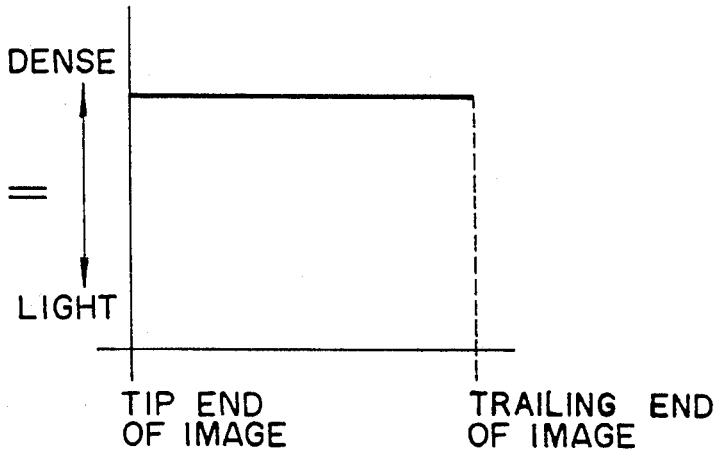

The above example, when an image of the original having a uniform density is copied, i.e., where a latent image having a uniform potential distribution is developed, is schematically shown in FIGS. 5A to 5C. FIG. 5A shows the density irregularity caused by the deformed developing sleeve 15, and FIG. 5B shows the density irregularity caused by the deformed developing sleeve 17. FIG. 5C shows the density distribution of the image after the image is developed by the developing sleeves 15 and 17.

As will be apparent from FIGS. 5A to 5C, the density irregularity caused by the deformed developing sleeve 15 is cancelled by the density irregularity caused by the deformed developing sleeve 17, thereby obtaining an image having a uniform density distribution.

In order to maintain the above-mentioned angular difference $(\beta-\alpha)$ to $(2\pi/2)\times k$ (rad.), the following equation must be satisfied:

$$L=k\times(\pi D/2)\times(N/n) \quad (1)$$

Where, L (mm) is a distance between the points A and B along the peripheral surface of the photosensitive drum 3 (i.e., a distance that the point R is moved from the point A to the point B), and D (mm) is a diameter of the photosensitive drum 3.

A time T (sec) required for shifting the point R on the photosensitive drum 3 from the point A to the point B is as follows:

$$T=L/(ND/2)=k\times\pi/n \quad (2)$$

Since the angular velocity of each of a developing sleeves 15, 17 is n (rad./sec.), during the above time T (sec), the developing sleeves 15, 17 are rotated by $k\times\pi$ (rad.).

In other words, the angular difference between the angle by which the developing sleeve 15 is rotated until the point R on the photosensitive drum 3 reaches the point A and the angle by which the developing sleeve 17 is rotated until the point R reaches the point B from the point A becomes $k\times\pi$ (rad.) (in this case, k is an odd number).

Accordingly, as shown in FIGS. 5A to 5C, the density irregularity caused by the developing sleeve 15 is offset from the density irregularity caused by the developing sleeve 17 by a half of a period or pitch so that they are cancelled by each other, thereby eventually obtaining an image without density irregularity.

Incidentally, for example, when the diameter of the photosensitive drum 3 is 100 mm, the angular velocity N of the photosensitive drum 3 is $10\pi/3$ (rad./sec.), the angular velocity of the respective developing sleeves 15, 17 is $50\pi/3$ (rad./sec.) and k is 1, the distance K between the points A and B along the peripheral surface of the photosensitive drum becomes $10\pi$ (mm). In this case, the time T becomes 0.06 second and the angular difference $(\beta-\alpha)$ becomes $\pi$ (rad.) i.e., 180 degrees. Of course, k may be set to any odd number other than 1.

Figure 6:
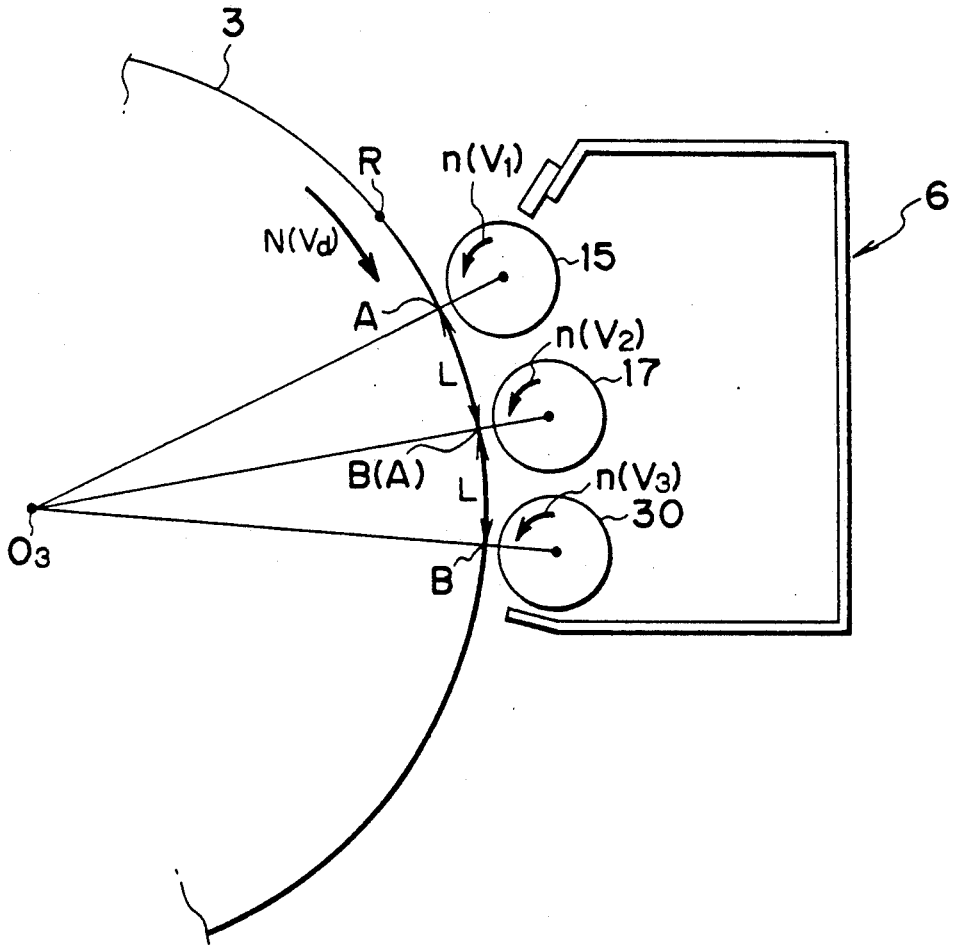
FIG. 6 is an enlarged view for explaining another embodiment of the present invention.

In the above example, two developing sleeves were used. As shown in FIG. 6, three or more developing sleeves may be used. In this case, a distance L (mm) between positions A and B along the peripheral surface of the photosensitive drum 3 is selected so that an angular difference $(\beta-\alpha)$ between an angle $\alpha$ by which one developing sleeve (15 or 17) is rotated until any point R on the photosensitive drum reaches the first position A where a distance between the one sleeve and the photosensitive drum is minimum and an angle $\beta$ by which another developing sleeve (17 or 30) is rotated until the point R on the photosensitive drum 3 reaches the second position B where a distance between the another sleeve and the photosensitive drum is minimum becomes $(2\pi/S)\times k$ (rad.).

Now, the distance L can be indicated by the following equation:

$$L=k\times(\pi D/S)\times(N/n) \quad (3)$$

Where, D is a diameter (mm) of the photosensitive drum, N is an angular velocity (rad./sec.) of the photosensitive drum, n is an angular velocity (rad./sec.) of each developing sleeve, S is the number of the developing sleeves, and k is an integral number excluding multiples of S.

In the above explanation, while the angular velocities of the photosensitive drum and of the developing sleeves were referred to, when peripheral speeds of the photosensitive drum and the developing sleeves are referred to, the explanation can be stated in other words as follows:

It is assumed that the radii of the developing sleeves 15, 17 are $r_1$ (mm), $r_2$ (mm), respectively and peripheral speeds of these sleeves are $V_1$ (mm/sec.), $V_2$ (mm/sec.), respectively. Further, it is assumed that a peripheral speed of the photosensitive drum 3 is Vd (mm/sec.). The value $r_1$, $r_2$, $V_1$, $V_2$, Vd and L are set to satisfy the following equations:

$$V_2/r_2=V_1/r_1 \quad (4)$$

$$L=k\times(\tfrac{1}{2})\times 2\pi r_1\times(Vd/V_1) \quad (5)$$

Where, k is an integral number excluding multiples of 2.

Now, a period (pitch) $P_1$ (mm) of the density irregularity caused by the thermal deformation of the developing sleeve 15 can be expressed as follows:

$$P_1=2\pi r_1\times(Vd/V_1) \quad (6)$$

And, a period (pitch) $P_2$ (mm) of the density irregularity caused by the thermal deformation of the developing sleeve 17 can be expressed as follows:

$$P_2=2\pi r_2\times(Vd/V_2) \quad (7)$$

Since $r_1/V_1=r_2/V_2$, the pitch $P_1$ equal to the pitch $P_2$.

Accordingly, the distance L can be expressed as follows:

$$L=k\times(P_1/2)=k\times(P_2/2) \quad (8)$$

Therefore, the minimum density portion of the image developed by the developing sleeve 15 is overlapped with the maximum density portion of the image developed by the developing sleeve 17, and the maximum density portion of the image developed by the developing sleeve 15 is overlapped with the minimum density portion of the image developed by the developing sleeve 17.

Figure 7:
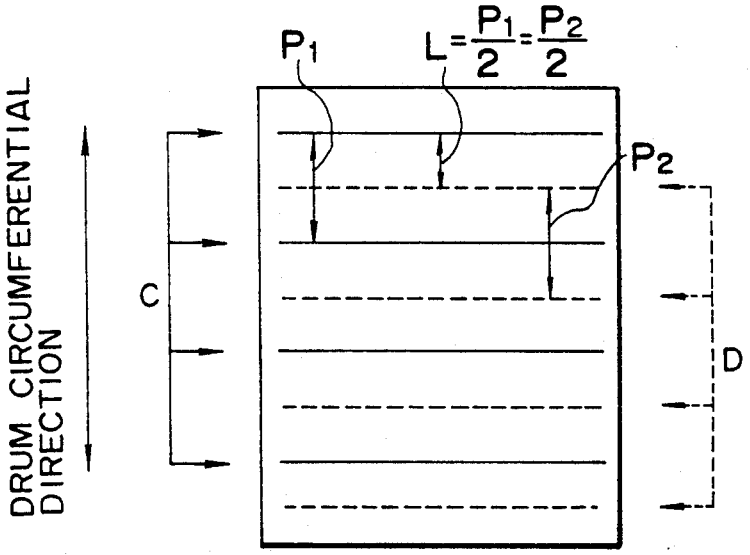
FIG. 7 is an explanatory view for explaining the effect of the embodiment.

As a result, an image developed by the two developing sleeves 15, 17 has a uniform density because the density irregularity of the image is corrected. FIG. 7 shows such conditions, where the maximum density portions of the image developed by the developing sleeve 15 are shown by the arrows C and the maximum density portions of the image developed by the developing sleeve 17 are shown by the arrows D. Further, the portions C are offset from the portions D by a half of the pitch $P_1$ ($P_1/2$), thereby cancelling the density irregularity with each other.

The following Table 1 shows the data of developing devices ①-④ used in the test. In the test, a half-tone original having a uniform density of 0.6 was copied and the density irregularities of the copies were measured.

TABLE 1

| | ① | ② | ③ | ④ |
|---|---|---|---|---|
| $V_1$ (mm/s) | 494 | 494 | 380 | 380 |
| $V_2$ (mm/s) | 494 | 309 | 380 | 456 |
| $V_3$ (mm/s) | — | — | 380 | — |
| $r_1$ (mm) | 10 | 16 | 8 | 10 |
| $r_2$ (mm) | 10 | 10 | 8 | 16 |
| $r_3$ (mm) | — | — | 8 | — |
| Vd (mm/s) | 380 | 380 | 380 | 380 |
| L (mm) | 24 | 38 | 17 | 33 |

The following Table 2 shows the density irregularities of the copied images obtained by the developing devices ①-④. ΔD is a difference in density between the maximum density portion and the minimum density portion.

TABLE 2

| | ① | ② | ③ | ④ |
|---|---|---|---|---|
| ΔD | 0.1 | 0.2 | 0.08 | 0.4 |

The developing device ① in Table 1 represents the case of $r_1=r_2$ and $V_1=V_2$, and satisfies the above equation (5) and, accordingly, the equation (1). The difference ΔD of the toner image obtained by this developing device is 0.1, as shown in Table 2, and, such density irregularity is visually negligible.

In the above-mentioned embodiment, while an example that the radii $r_1$, $r_2$ of the developing sleeves 15, 17 are the same and the peripheral speeds $V_1$, $V_2$ of the developing sleeves are also the same was explained, the present invention is not limited to such an example so long as the above equations are satisfied. For example, as shown in FIG. 8, the radius $r_1$ of the upstream developing sleeve 15 may be greater than the radius $r_2$ of the downstream developing sleeve 17 and the peripheral speed $V_2$ of the downstream developing sleeve 17 may be smaller than the peripheral speed $V_1$ of the upstream developing sleeve 15.

Figure 8:
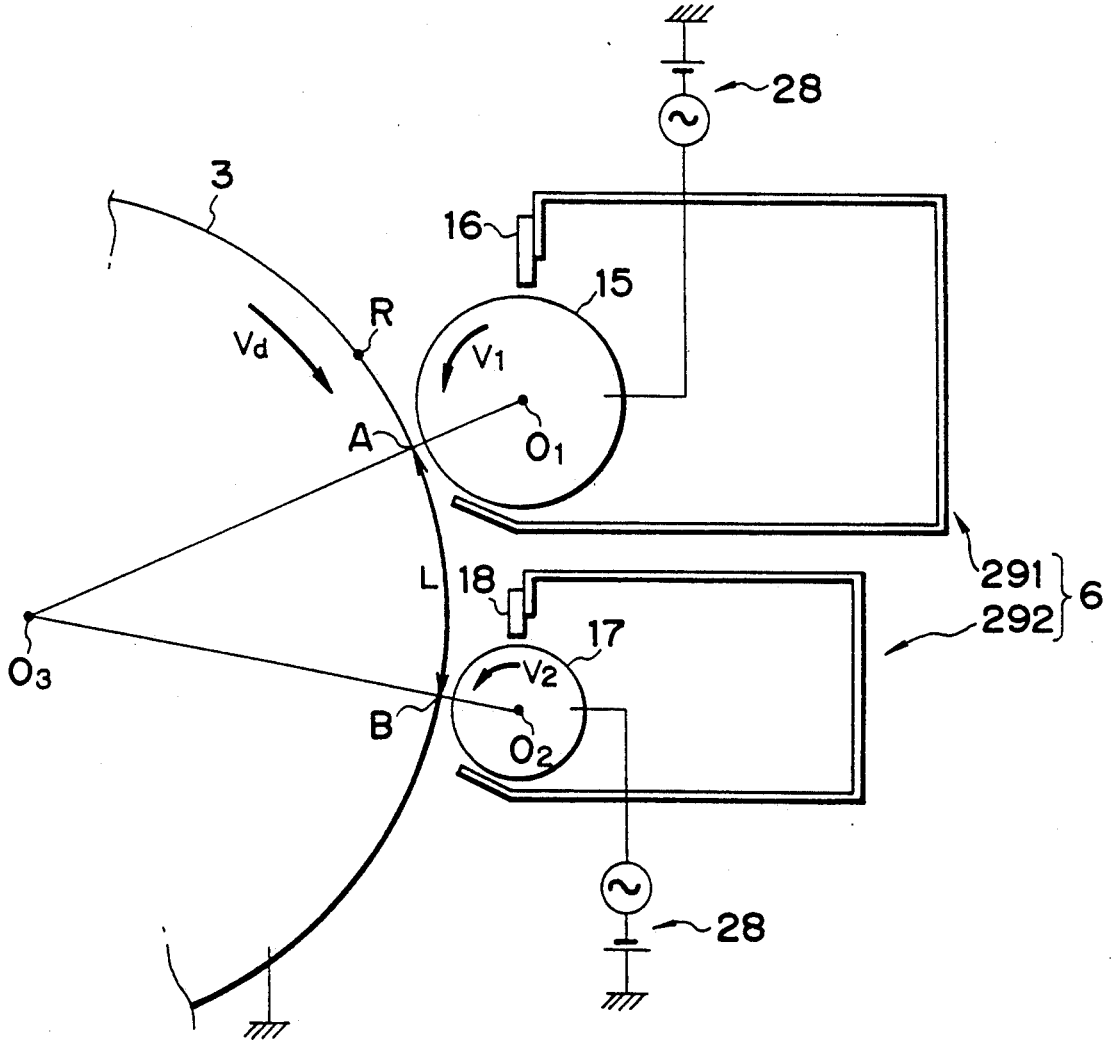
FIG. 8 is an enlarged view for explaining a further embodiment of the present invention.

The developing device ② in Table 1 shows the above example in FIG. 8. This developing device satisfies the above equations (4) and (5), and, thus, satisfies the equation (1). The difference ΔD of the toner image obtained by this developing device is 0.2 as shown in Table 2, and, such density irregularity is visually negligible.

Incidentally, in FIG. 8, while the sleeve 15 was arranged in a developer container 291 and the sleeve 17 was arranged in a developing container 292 independently from the container 291, these sleeves 15, 17 may be arranged in the same developer container 6. In any case, in FIG. 8, the developers having the same color are contained in the developer containers 291, 292, and, thus, the developing sleeves 15, 17 can develop the same latent image with same color developers.

In the above example, two developing sleeves were used. However, three developing sleeves may be used, as shown in FIG. 6.

In this case, when a peripheral speed of a developing sleeve 30 is $V_3$ (mm/sec.) and a radius of the developing sleeve 30 is $r_3$ (mm), the values $V_1$, $V_2$, $V_3$, Vd, $r_1$, $r_2$, $r_3$ and L are set to satisfy the following equations:

$$V_3/r_3=V_2r_2=V_1/r_1 \quad (9)$$

$$L=k\times(\tfrac{1}{3})\times 2\pi r_1\times(Vd/V_1) \quad (10)$$

Where, k is an integral number excluding multiples of 3.

The periods (pitches) $P_1$, $P_2$, $P_3$ of the density irregularities caused by the developing sleeves are the same, and the following equation is satisfied:

$$P_1=P_2=P_3=2\pi r_1\times(Vd/V_1) \quad (11)$$

Thus, the following relation can be obtained:

$$L=P_1/3$$

Figure 9:
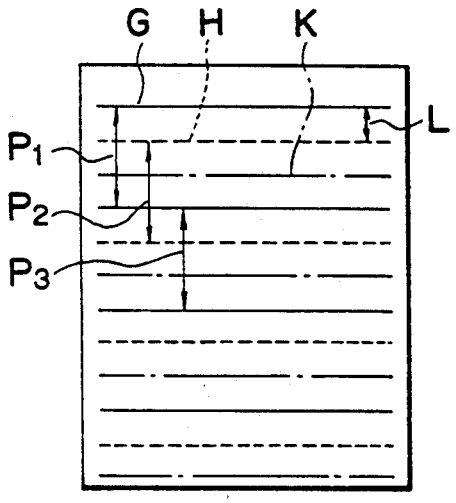
FIG. 9 is an explanatory view for explaining the effect of the embodiment.

That is to say, the pitches of the density irregularities caused by the respective developing sleeves are the same, and the maximum density portions of the images obtained by the respective developing sleeves are offset from each other by $\frac{1}{3}$ of the pitch. FIG. 9 shows an image outputted from this developing device. In the outputted image, the density irregularities G, H, K due to the developing sleeves 15, 17, 30 are corrected or cancelled with each other, and the resultant density irregularity of the toner image was eliminated.

The developing device ③ in Table 1 represents the above example in FIG. 9. As shown in Table 2, the density irregularity ΔD of the toner image formed by this developing device is 0.08, which is visually negligible.

Incidentally, in general, in an image forming apparatus wherein S (in number) developing sleeves are used, when the radii of the respective developing sleeves are ri (i=1, 2 , . . . S) and the peripheral speeds of the respective developing sleeves are Vi (i=1, 2 , . . . S) the values ri, Vi, Vd and L may be set to satisfy the following equations:

$$Vi/ri=V_1/r_1 \quad (12)$$

$$L=k\times(1/S)\times(2\pi r_1)\times(Vd/V_1) \quad (13)$$

Figure 10:
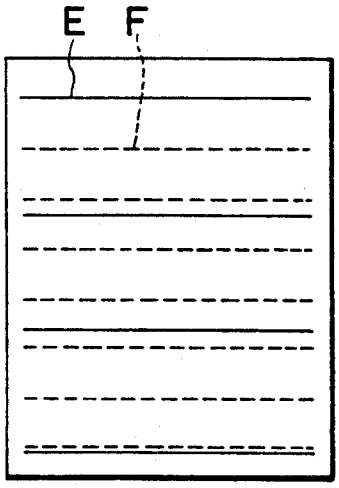
FIG. 10 is an explanatory view for explaining the effect of a comparison example.

Incidentally, the developing device ④ in Table 1 does not satisfy equations (4) and (5), and, thus, does not satisfy equation (1). The density irregularity ΔD of the toner image obtained by this developing device was as great as 0.4. This is the reason that, as shown in FIG. 10, since the pitch of the density irregularity E caused by the developing sleeve 15 differs from the pitch of the density irregularity F caused by the developing sleeve 17, the density irregularities are not cancelled with each other, but are partially overlapped with each other.

In the above examples, since the developing sleeves start to rotate simultaneously in response to an image forming operation, rotations of the developing sleeves can easily be controlled; however, the distance L must be set to satisfy equation (1) or (5).

In the following example, a value of the distance L can be freely set. In this example, by delaying the start of the rotation of the downstream developing sleeve 17 with respect to the start of the rotation of the upstream developing sleeve 15 by a time t (sec.), an angular difference ($\beta-\alpha$) between an angle $\alpha$ (rad.) by which one developing sleeve 15 is rotated until any point R on the photosensitive drum 3 reaches a first position A where a distance between the one developing sleeve and the photosensitive drum 3 is minimum and an angle $\beta$ by which another developing sleeve 17 is rotated until the point R on the photosensitive drum 3 reaches a the point R on the photosensitive drum 3 reaches a second position B where a distance between another sleeve and the photosensitive drum is minimum becomes $(2\pi/S)\times k$ (rad.). Where S is the number of the developing sleeves and k is an integral number excluding multiples of S.

The above time t (sec.) can be determined from the following equation:

$$t=2\times\{L-k\times(\pi D/S)\times(N/n)\}/(D\times N) \quad (14)$$

Figure 11:
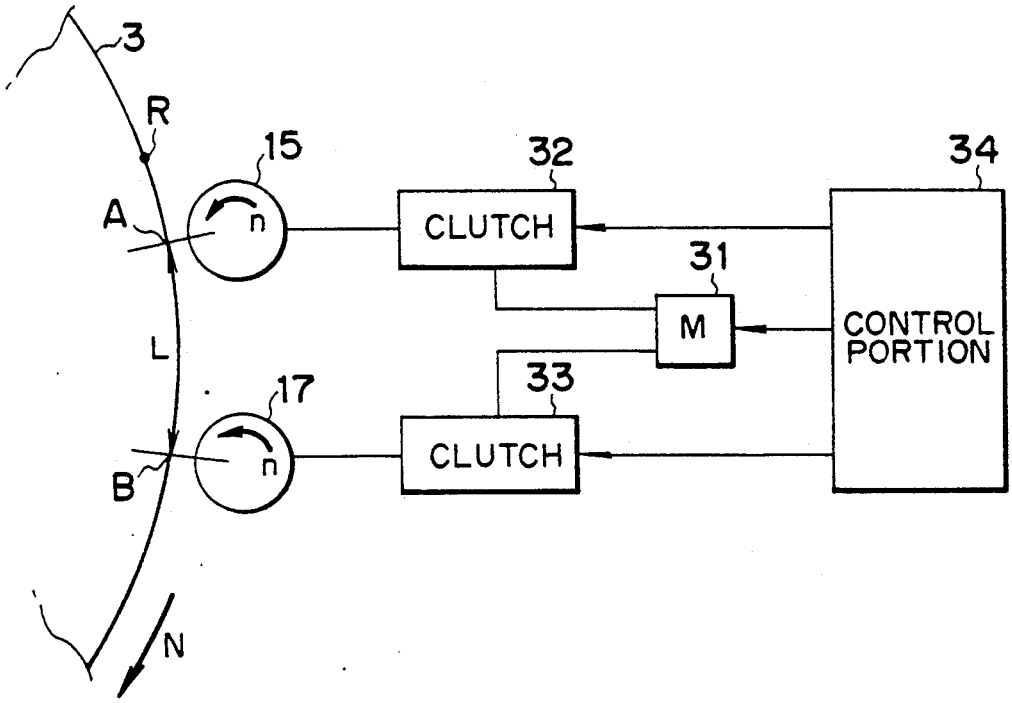
FIG. 11 is a schematic view for explaining a further embodiment of the present invention.

In FIG. 11, the sleeve 15 is rotated by a driving force of a motor 31 via a first clutch 32, and the sleeve 17 is rotated by the driving force of the motor 31 via a second clutch 33. A control portion 34 firstly activates the first clutch 32 to rotate sleeve 15 firstly, and then, after the time t (sec.) is elapsed, the control portion activates the second clutch 33 to rotate sleeve 17.

FIGS. 4 and 11 show an example of the developing device wherein two developing sleeves are used.

When the diameter D of the photosensitive drum 3 is 100 mm, the angular velocity N of the drum is $10\pi/3$ (rad./sec.), the angular velocity of each of developing sleeves 15, 17 is $50\pi/3$ (rad./sec.), the distance L is 25 $\pi$mm and k is 1, the above delay time t becomes 0.09 second.

Now, when it is assumed that the point R on the photosensitive drum 3 is developed at the point $Q_1$ on the sleeve 15, the point R is then developed at the point $Q_2$ on the sleeve 17 which is rotated after the rotation of the sleeve 15 with the time delay of 0.09 second. In FIG. 4, when an angle formed by $P_1-O_1-Q_1$ is $\alpha$ (rad.), an angle $\beta$ formed by $P_2-O_2-Q_2$ becomes $(\alpha+\pi)$ (rad.).

This is the reason that, although a time required for shifting the point R on the photosensitive drum 3 from the point A to the point B (25 $\pi$mm) is 0.15, since the start of rotation of the sleeve 17 is delayed with respect to the start of rotation of the sleeve 15 by 0.09 second, the difference between the angle $\beta$ and the angle corresponds to an angle that the sleeve 17 is rotated by 0.06 second, i.e., an angle of $\pi$(rad.) or 180 degrees.

In any case, in this way, similar to the explanation in connection with FIG. 5 or FIG. 7, the density irregularity caused by sleeve 15 is cancelled by the density irregularity caused by sleeve 17, thereby eventually obtaining an image having no density irregularity. Incidentally, this example can also be applied to the case where three or more developing sleeves are used.

Incidentally, the present invention can also be applied to an image forming apparatus of a so-called contacting developing type wherein a latent image is developed while contacting a developer layer carried by a developing sleeve with a photosensitive drum and also can be applied to an image forming apparatus wherein a latent image is developed by using a two-compartment developer comprised of toner particles and carrier particles.

What is claimed is:

1. An image forming apparatus, comprising:

a movable image bearing member capable of bearing an electrostatic latent image;

heating means arranged within said image bearing member for heating said image bearing member both during an image forming operation and during an inoperative condition; and a plurality of developing sleeves arranged along a moving direction of said image bearing member sequentially, said developing sleeves being rotated during the image forming operation to convey and supply developers having the same color to said image bearing member;

wherein an angular difference between an angle by which one of said developing sleeves is rotated until a point on said image bearing member reaches a first position where a distance between said developing sleeve and said image bearing member is minimum, and an angle by which another developing sleeve adjacent to said one developing sleeve at a downstream side in the moving direction of said image bearing member is rotated until said point on the image bearing member reaches a second position where a distance between said another developing sleeve and said image bearing member is minimum, becomes $(2\pi/S)\times k$ (rad.) (where S is number of developing sleeves and k is an integral number excluding the multiples of S).

2. An image forming apparatus according to claim 1, wherein said plurality of developing sleeves are rotated simultaneously, and wherein, when a moving distance of said image bearing member between said first and second position is L (mm), a diameter of said image bearing member is D (mm), an angular velocity of said image bearing member is N (rad./sec.) and an angular velocity of each of said developing sleeves is n (rad./sec.), the following relation is obtained:

$$L=k\times(\pi D/S)\times(N/n).$$

3. An image forming apparatus according to claim 1, wherein said plurality of developing sleeves start to rotate so that a start of rotation of one developing sleeve is delayed with respect to an upstream developing sleeve adjacent to said one developing sleeve, and wherein, when a time difference between the start of rotation of said one developing sleeve and that of said upstream developing sleeve is t (sec.), a moving distance of said image bearing member between said first and second position is L (mm), a diameter of said image bearing member is D (mm), an angular velocity of said image bearing member is N (rad./sec.) and an angular velocity of each of said developing sleeves is n (rad./sec.), said time difference is determined by the following equation:

$$t=2\times\{L-k\times(\pi D/S)\times(N/n)\}/(D\times N).$$

4. An image forming apparatus, comprising:

a movable image bearing member capable of bearing an electrostatic latent image;

a heating means arranged within said image bearing member for heating said image bearing member both during an image forming operation and during an inoperative condition; and a plurality of developing sleeves arranged along a moving direction of said image bearing member sequentially, said developing sleeves being rotated during the image forming operation to convey and supply developers having the same color to said image bearing member, and said developing sleeves being rotates simultaneously;

wherein, when the number of said developing sleeves is S, radii of the respective developing sleeves are ri (i=1, 2 , . . . , S) (mm), peripheral speeds of the respective sleeves are Vi (i=1, 2 , . . . , S) (mm/sec.), a peripheral speed of said image bearing member is Vd (mm/sec.), a distance along a peripheral surface of said image bearing member between a first position where one of said developing sleeves approaches said image bearing member at a maximum distance and a second position where another developing sleeve adjacent to said one developing sleeve at a downstream side in the moving direction of said image bearing member approaches said image bearing member at a minimum distance is L (mm), and k is an integral number excluding multiples of S, the following relations are obtained:

$$Vi/ri = V_1/r_1, \text{ and}$$

$$L = k \times (1/S) \times (2\pi r_1) \times (Vd/V_1).$$

* * * * *

UNITED STATES PATENT AND TRADEMARK OFFICE

CERTIFICATE OF CORRECTION

PATENT NO. :5,300,987

DATED :April 5, 1994

INVENTOR(S) :Aoyama et al.

It is certified that error appears in the above-indentified patent and that said Letters Patent is hereby corrected as shown below:

Column 1

Line 14, change "electrophotographic" to --electrophotographic photosensitive member--.

Column 2

Line 38, change "o" to --of--.

Column 3

Line 33, "change "a" to --an--.
Line 51, change "the" (first occurrence) to --an--.

Column 5

Line 44, delete "a".

Column 6

Line 5, change "(mn)" to --(mm)--.

Column 8

Line 16, change "$V_3/r_3 = V_2r_2 = V_1/r_1$....(9) to --$V_3/r_3 = V_2/r_2 = V_1/r_1$....(9).

UNITED STATES PATENT AND TRADEMARK OFFICE

CERTIFICATE OF CORRECTION

PATENT NO. :5,300,987 Page 2 of 2

DATED :April 5, 1994

INVENTOR(S) :Aoyama et al.

It is certified that error appears in the above-indentified patent and that said Letters Patent is hereby corrected as shown below:

Column 9

Line 14, delete "the" (second occurrence).
Line 15, delete "point R on the photosensitive drum 3 reaches a".

Column 10

Line 2, change "two-compartment" to --two component--.

Column 11

Line 9, change "rotates" to --rotated--.

Signed and Sealed this

Twentieth Day of September, 1994

Bruce Lehman

*Attest:*

BRUCE LEHMAN

*Attesting Officer*

*Commissioner of Patents and Trademarks*